US007448096B2

(12) United States Patent
Schoenherr et al.

(10) Patent No.: US 7,448,096 B2
(45) Date of Patent: Nov. 11, 2008

(54) SHOWER ASSEMBLY

(75) Inventors: Tom Schoenherr, Stuttgart (DE); Andreas Haug, Stuttgart (DE); Andreas Dimitriadis, Lorch (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 10/509,567

(22) PCT Filed: Jan. 27, 2004

(86) PCT No.: PCT/EP2004/000655

§ 371 (c)(1),
(2), (4) Date: Sep. 29, 2004

(87) PCT Pub. No.: WO2004/069018

PCT Pub. Date: Aug. 19, 2004

(65) Prior Publication Data

US 2005/0251905 A1 Nov. 17, 2005

(30) Foreign Application Priority Data

Feb. 6, 2003 (DE) ..... 103 05 786

(51) Int. Cl.
*A47K 3/022* (2006.01)

(52) U.S. Cl. ..... 4/601; 4/602; 4/603; 4/596; 4/597

(58) Field of Classification Search ..... 4/601–603, 4/596, 597

See application file for complete search history.

(56) References Cited

U.S. PATENT DOCUMENTS

| | | | | | |
|---|---|---|---|---|---|
| 439,793 | A | * | 11/1890 | Taylor | 4/601 |
| 585,439 | A | * | 6/1897 | Hooper | 4/601 |
| 596,115 | A | * | 12/1897 | Jendis | 4/601 |
| 870,766 | A | * | 11/1907 | Eaton | 4/601 |
| 2,336,402 | A | | 12/1943 | Kaiser | |
| 5,060,322 | A | | 10/1991 | Delepine | |
| 5,073,996 | A | * | 12/1991 | Schinle | 4/601 |
| 5,469,587 | A | * | 11/1995 | Demeny | 4/615 |
| 6,745,414 | B2 | * | 6/2004 | Zhou | 4/601 |
| D518,155 | S | * | 3/2006 | Haug et al. | D23/304 |

FOREIGN PATENT DOCUMENTS

| | | | |
|---|---|---|---|
| DE | 39 01 162 | A1 | 7/1990 |
| DE | 29604312 | U1 | 8/1996 |
| EP | 0406500 | A1 * | 7/1989 |
| FR | 65.900 | A | 3/1956 |
| FR | 65990 | * | 3/1956 |
| FR | 1.450.087 | A | 5/1966 |
| GB | 166908 | A | 12/1919 |
| GB | 593048 | A | 5/1946 |

* cited by examiner

*Primary Examiner*—Khoa D Huynh
(74) *Attorney, Agent, or Firm*—Duane Morris LLP

(57) ABSTRACT

A shower arrangement designated to be affixed to a showering area comprises an arced hollow section inside of which is a water line to a head nozzle at the top area of the arc. The arced hollow section has two preferably parallel legs that are both affixed to a wall. The arrangement can be affixed between two abutting walls, between two parallel walls, or also in front of a single wall.

7 Claims, 4 Drawing Sheets

SHOWER ASSEMBLY

Figure 1:
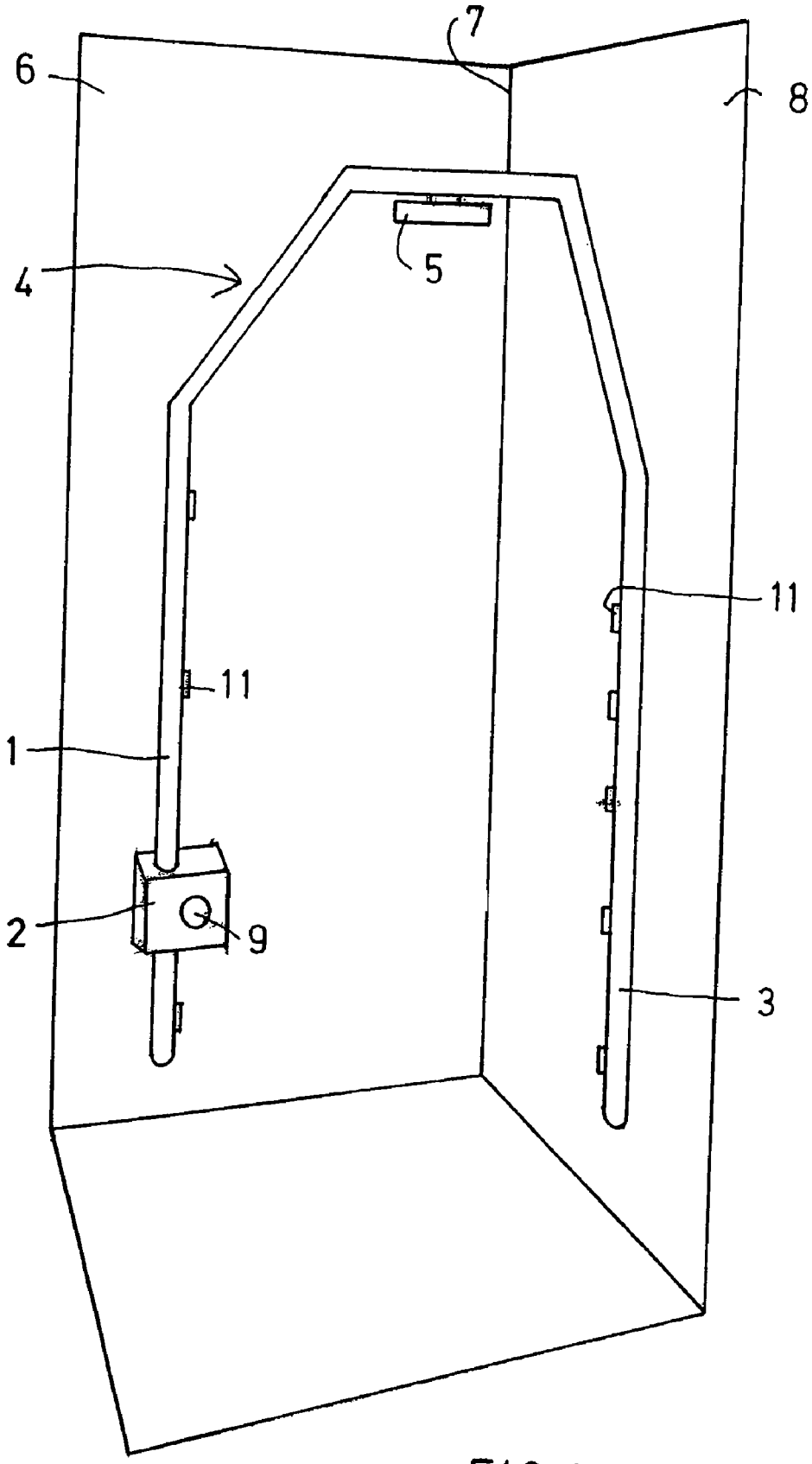

The invention is based on a shower arrangement having a permanently installed head nozzle arranged over a showering area.

In a known shower arrangement of this kind (U.S. Pat. No. 2,336,402), a showering area is disposed as a cabin having three side walls. Pipes run vertically upward in the corners of the showering area and meet at a head nozzle above the middle of the showering area. Side nozzles are affixed to the vertical pipes.

To be understood as a "showering area" is a location where a user showers either sitting or standing. It can be a shower stall, shower cell or a place in a bathtub. Such a shower area also has an approximate center. The center can be a geometric center.

The invention is based on the task of creating a shower arrangement that has a simple design and can be used for different types of showering areas.

To solve this task, the invention proposes a shower arrangement with the features cited in claim 1. Developments of the invention are the subject of subclaims.

The shower arrangement hence contains an arced hollow section that ends in two legs. These two legs are connected with a cross-member to yield a stirrup shape. The cross-member can be arced to produce a U shape. It can also deviate from the arced form up to forming a straight line. It does not need to exactly contact the top ends of the legs and can be a certain distance from them. A nozzle is affixed to the cross-member such that it approximately lies over the center of the showering area.

Both legs lie at least partially in a plane, and the plane of both legs can be different.

This arrangement enables a nozzle, especially designed as a head nozzle, to be affixed above the center of the showering area. No additional holders are necessary with the exception of the arced hollow section.

It is conceivable to use the bottom ends of two legs to affix the shower arrangement. In an advantageous development of the invention, the two legs are especially designated for being permanently affixed to a wall or another vertical arrangement. Since the legs lie at least partially within a plane, they can be very easily affixed to a vertical surface. They can be affixed directly to the wall, or at a certain distance from the wall. Among other things, this depends on the type of hollow section, for example, if the section is flat or round.

The nozzle can for example be oriented over the middle of the showering area with an arm. It is particularly advisable, however, when the cross-member of the arced hollow section is arranged so that it runs over the center of the showering area.

It has already been mentioned that the two legs do not have to lie in the same plane. In another embodiment of the invention, both legs lie in the same plane.

Another possible leg design is for the legs to lie in parallel planes.

It is particularly advisable when the entire arced hollow section lies in one plane according to the invention.

In another possible embodiment proposed by the invention, the cross-member can bend out of the plane of at least one leg, and preferably out of the plane of both legs.

According to the invention, both legs can be straight. This is the simplest manufacturing possibility that also offers the widest variety of uses.

The invention proposes that at least one leg of the shower arrangement and preferably both legs are provided with at least one nozzle. These can be small, space-saving side nozzles.

At least one nozzle can preferably be supplied by a water line within the hollow section. It is of course also conceivable to affix a separate water line for example to the outside of the arced hollow section. For visual reasons, however, it is preferable for the water line to be disposed within the arced hollow section. This is all more desirable since the fitting housing is directly connected with one leg of the arced hollow section.

Figure 2:
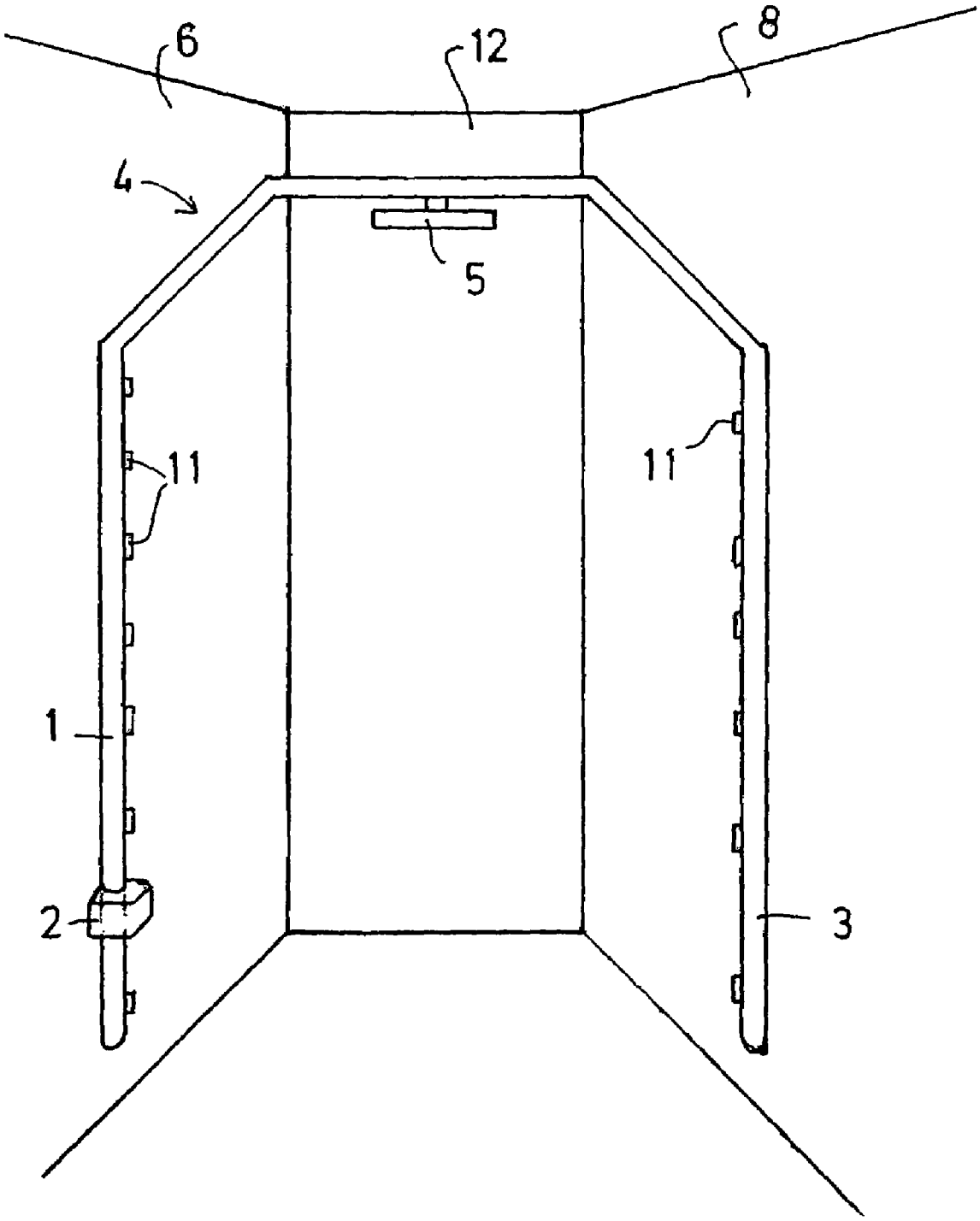
Figure 3:
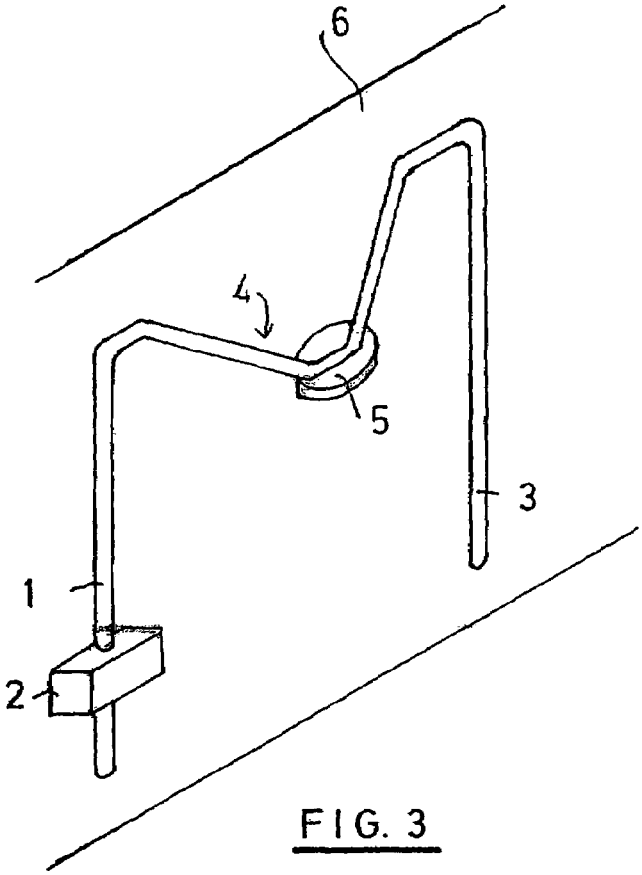
Figure 4:
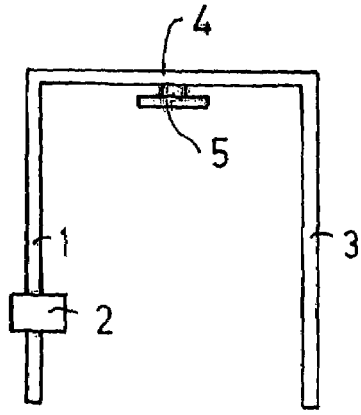
Figure 5:
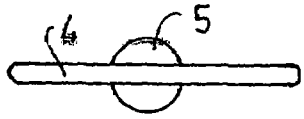
Figure 7:
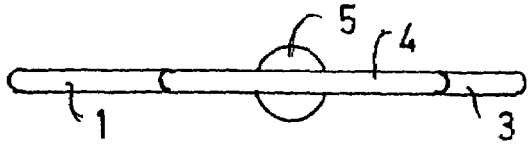
Figure 6:
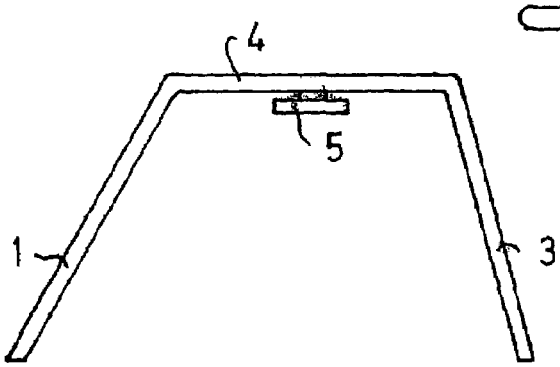
Figure 8:
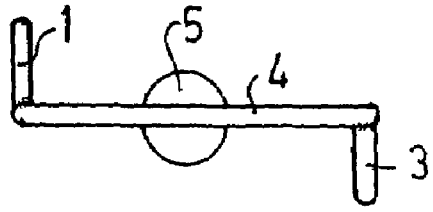
Figure 9:
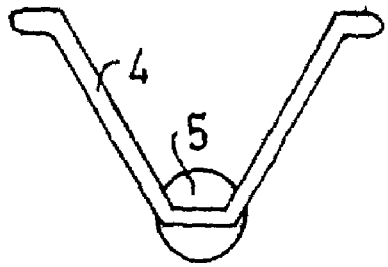
Figure 10:
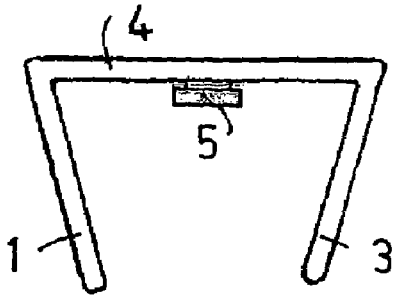
Figure 11:
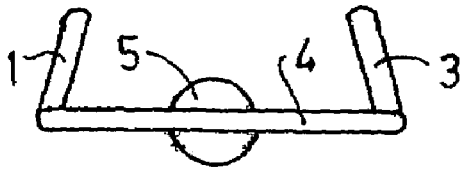

Additional features, details and preferences of the invention are found in the following description of preferred embodiments of the invention, the claims, abstract and drawing. The wording of the claims and abstract is made part of the description by means of reference. The following figures are shown:

FIG. 1 a schematic arrangement according to the invention over the corner in a shower stall;

FIG. 2 the shower arrangement proposed by the invention in a shower stall with two parallel walls;

FIG. 3 a schematic arrangement of an arced hollow section in front of an individual wall;

FIG. 4 a simplified representation of a front view of a shower arrangement;

FIG. 5 a top view of a shower arrangement whose front view would correspond to FIG. 4;

FIG. 6 a front view corresponding to FIG. 4 of an embodiment with diverging legs;

FIG. 7 a top view of the arrangement in FIG. 6;

FIG. 8 a top view corresponding to FIGS. 5 and 7 of another embodiment;

FIG. 9 a top view of an arrangement similar to FIG. 3;

FIG. 10 a front view corresponding to FIGS. 4 and 6 of another embodiment;

FIG. 11 A top view corresponding to FIG. 9 of the arrangement in FIG. 10.

FIG. 1 shows a schematic overview of how the shower arrangement according to the invention can be affixed in a shower stall with walls and a floor. The shower arrangement has a first leg 1 that is straight in the portrayed example and therefore lies in a plane. Leg 1 is provided with fitting housing 2 that is at operating height. In the portrayed example, leg 1 extends out of the top and bottom of the fitting housing 2. Even if leg 1 is not designed as a continuous pipe within the fitting housing, this impression is provided by the arrangement. Leg 1 therefore runs above and below the fitting housing 2 in a line.

The shower arrangement has a second leg 3 that is also straight in the portrayed example. It accordingly also lies in a plane. In the simplest case portrayed here, both legs 1,3 are parallel and therefore lie in the same plane.

The top areas of the two legs 1, 3 are connected by a cross-member 4 that does not need to be designed as a straight part but can consist of several angled or bent parts. To be understood as a "cross-member" is the part that connects the two legs to each other. In its top area, cross-member 4 is provided with nozzle 5, preferably a head nozzle that sprays directly downward.

The first leg 1 is affixed to a wall 6 of the shower stall at a distance from the corner 7 that connects this wall 6 with the second wall 8.

The second leg 3 of the shower arrangement is also affixed to a wall 8, i.e., the wall 8 joined to the first wall 6 via corner 7. The second leg 3 is also affixed at a distance from the corner 7. The cross-member 4 therefore runs almost diagonally across the showering area so that its top lies directly above the approximate middle of the showering area.

Legs 1,3 and cross-member 4 are designed as a continuous hollow section so that water proceeding from the fitting housing 2 can be guided through the inside of the hollow section to the head nozzle 5. Fittings which will not be further described are disposed within fitting housing 2, and said fittings can be operated by means of an operating element 9. Individual side nozzles 11 directed inward are disposed on both straight legs 1,3.

The hollow section provided with the fitting housing 2 can not only be arranged over a corner in a shower stall where the corner does not need to be a right angle, the hollow section can also be connected to two walls that do not join at a corner as shown in FIG. 2. Two walls 6,8 are indicated that are connected via a third wall 12. In particular, walls 6,8 can be parallel. In this case as well, the shower arrangement can be screwed to the two walls so that the cross-member 4 crossing the approximate middle of the showering area.

The same arrangement is used in FIGS. 1 and 2. In this instance, the entire arced hollow section lies in one plane. The legs are straight and parallel. FIG. 3 shows an embodiment in which the two legs 1,3 are also straight and parallel as well as lying in the same plane. However, the cross-member bends outside of the plane in which the two legs 1,3 lie. This arrangement can be affixed in front of an individual wall so that the nozzle 5 is disposed far enough from wall 6 to allow a showering area to also be formed in this instance. The plan view of the shower arrangement in FIG. 3 approximately corresponds to that in FIG. 9.

The following figures show highly simplified options of how the arced hollow section can be designed. The fitting housing 2 is sometimes left out. In addition, the cross-member 4 is always designed as a straight part. FIGS. 4 and 5 show a front and top view of the simplest design where both legs 1,3 are straight and parallel, i.e., in the same plane, and where cross-member 4 also lies in the same plane. This corresponds to the arrangement in FIGS. 1 and 2 apart from the fact that the cross-member is straight in this instance.

The front view of FIG. 4 also corresponds to the arrangement in FIG. 3.

FIGS. 6 and 7 show an arrangement in which the arced hollow section lies in a plane with two legs 1,3 and cross-member 4; however, the two legs 1,3 are not parallel. For visual reasons, such an arrangement can be recommendable. With the arrangement in FIG. 6, it is of course also possible to design the cross-member as in the arrangement in FIG. 3.

FIG. 8 shows another possible arrangement in which the two legs 1,3 are parallel viewed from the front, but not from the top. In this embodiment, the two legs 1,3 lie in parallel planes. This arrangement could for example be affixed as shown in FIG. 2.

FIG. 9 shows a top view that for example corresponds to FIG. 3. However, an arrangement with two diverging legs 1,3 as in FIG. 6 could be designed so that the cross-member 4 is bend forward out of the plane of the two legs 1,3.

FIG. 10 shows a front view of an embodiment in which the two legs 1,3 converge. FIG. 11 shows a top view of the arrangement in FIG. 10 from which it can be seen that the two legs also converge to the rear. Both legs 1,3 also lie in their own plane, and the planes of the two legs do not coincide. Such an arrangement can for example be affixed in a corner where the angle between the two planes of the two legs 1,3 corresponds with the corner angle.

What is claimed is:

1. A shower arrangement fixed in a shower room having at least one wall bordering a showering area, and a supply of water at said wall, a fitting housing affixed to said wall at an operating height and coupled to the supply of water at the wall, wherein said fitting housing has an operating element that controls the supply of water to a continuous hollow section of the shower arrangement, the continuous hollow section consisting of two parallel pipe legs and a cross-member, a first pipe leg of said two parallel pipe legs being permanently affixed with respect to the wall and extending upwardly from the fitting housing parallel to a plane of the wall, wherein the first pipe leg is coupled directly to said fitting housing so as to carry water from the fitting housing to the shower arrangement, a second pipe leg of said two parallel pipe legs being spaced from the first pipe leg and extending upwardly, the second pipe leg being parallel to the first pipe leg so that both said pipe legs lie in a plane, and the second pipe leg is adapted to be affixed to a wall, the cross-member connecting top ends of the first and second pipe legs so as to carry water from the fitting housing to the second pipe leg, the first and second pipe legs with the cross member forming an arced hollow section extending for a distance around the showering area, wherein the cross-member couples to the fitting housing through the first pipe leg, and wherein at least one nozzle is coupled to the arced hollow section and directs water from the fitting housing into the showering area.

2. The shower arrangement according to claim 1, in which the cross-member is guided over a center of the showering area spaced from the wall of the room.

3. The shower arrangement according to claim 1, in which the arced hollow section lies in the plane of the pipe legs.

4. The shower arrangement according to claim 1, in which the cross-member bends out of the plane of the pipe legs.

5. The shower arrangement according to claim 1, in which both said legs are straight.

6. The shower arrangement according to claim 1, further comprising a nozzle coupled to at least one of said legs directing water from said fitting housing into the showering area.

7. The shower arrangement according to claim 6, wherein the arced hollow section provides a water line carrying water from the fitting housing to at least one nozzle coupled to the second of the legs.

* * * * *